United States Patent [19]

Kernon et al.

[11] Patent Number: 4,854,821

[45] Date of Patent: Aug. 8, 1989

[54] ROTOR ASSEMBLY

[75] Inventors: John D. Kernon, Clevedon; Kenneth R. Langley, Gloucestershire; Mark R. Thatcher, Gwent, all of England

[73] Assignee: Rolls-Royce plc, England

[21] Appl. No.: 160,316

[22] Filed: Feb. 25, 1988

[30] Foreign Application Priority Data

Mar. 6, 1987 [GB] United Kingdom ..... 8705216

[51] Int. Cl.[4] ..... F04D 5/18

[52] U.S. Cl. ..... 416/95; 416/193 A; 416/220 R

[58] Field of Search ..... 416/193 A, 193 R, 220 R, 416/219 R, 221, 95, 241 B

[56] References Cited

U.S. PATENT DOCUMENTS

| | | | |
|---|---|---|---|
| 2,755,063 | 7/1956 | Wilkinson | 416/221 |
| 2,998,959 | 9/1961 | Haworth et al. | 416/193 A |
| 3,295,825 | 1/1967 | Hall | 416/193 A |
| 4,017,209 | 4/1977 | Bodman | 416/241 B X |
| 4,094,615 | 6/1978 | Glenn | 416/241 B X |
| 4,111,603 | 9/1978 | Stahl | 416/220 R X |
| 4,192,633 | 3/1980 | Herzner | 416/220 R X |
| 4,480,959 | 11/1984 | Bourguignon et al. | 416/220 R X |
| 4,701,105 | 10/1987 | Cantor et al. | 416/220 R |

FOREIGN PATENT DOCUMENTS

| | | | |
|---|---|---|---|
| 590470 | 1/1960 | Canada | 416/220 R |
| 2324873 | 4/1977 | France | 416/193 A |
| 779059 | 7/1957 | United Kingdom . | |
| 1238090 | 7/1971 | United Kingdom . | |
| 2016092 | 9/1979 | United Kingdom . | |
| 1575500 | 9/1980 | United Kingdom . | |
| 2058945 | 4/1981 | United Kingdom . | |
| 2095763 | 10/1982 | United Kingdom . | |

*Primary Examiner*—Everette A. Powell, Jr.
*Attorney, Agent, or Firm*—Oliff & Berridge

[57] ABSTRACT

A rotor assembly for use in a rotodynamic machine comprises a rotor disc (10) with a plurality of blades (14) attached to its outer rim (12) and a seal plate (22) for substantially preventing the escape of blade cooling air. The rotor disc (10) is provided with a plurality of hooked restraining members (30) each including a radially inward directed abutment face (32) which in use restrain the seal plate from moving axially and from moving radially outward under centrifugal force by abutment with the seal plate. In this way the blades (14) are not subjected to additional loading by the seal plate (22).

8 Claims, 3 Drawing Sheets

ROTOR ASSEMBLY

This invention relates to a rotor assembly for use in a rotodynamic machine such as a gas turbine engine.

A common configuration for an axial turbine of a gas turbine engine is for a plurality of blades, having fir-tree roots, to be retained in a rotor disc rim by insertion into a corresponding fir-tree slot broached in a generally axial direction. An annular or segmented seal plate is then fastened to the downstream side of the rotor disc rim, usually by engagement of its outer periphery in a slot formed on the underside of the blade platforms and by close sealing contact with the rotor disc rim. The main purpose of the seal plate is to prevent gas leakage via gaps between the blade roots and the fir-tree slots.

The problem of isolating the effects of the seal plate on the damping of vibrations of the blades is very important. There is therefore a need to be able to form an effective seal whilst ensuring that the seal plate does not constrain the movements of the blades.

BP2095763A discloses a seal plate which reduces the centrifugal loads on the blades but which uses the rotation of the radial outer portion of the seal plate about a fulcrum on the disc to exert axial loads on the blade roots and on the underside of the platforms of the blades. The rotation of the inclined radial outer portion of the seal plate under centrifugal loads is designed to push the radially inner part of the seal plate onto the blade roots and disc. Hence this seal plate imposes considerable loads on the blades which will tend to modify or damp the vibrations of the blades. The tendency now is to design vibration dampers for location under the blade platforms which act on the blades and do not fight against the actions of the seal plates.

This invention seeks to provide a rotor assembly in which the seal plate does not exert a significant centrifugal and damping load on the blades.

The present invention achieves these aims by providing hook means on the disc through which radial loads on the seal plate are reacted and by effectively ensuring that the outer perimeter of the seal plate does not contact the blade platforms and therefore cannot impose significant loads radially or circumferentially on the blade platforms. The hook means also provides axial constraint on the seal plate thus obviating the need for the outer perimeter of the seal plate to apply an axial sealing force. In this way one can eliminate any undesired damping loads being imparted by the seal plate to the blade platforms.

The invention will now be described in detail by way of examples with reference to the accompanying drawings in which.

Figure 1:
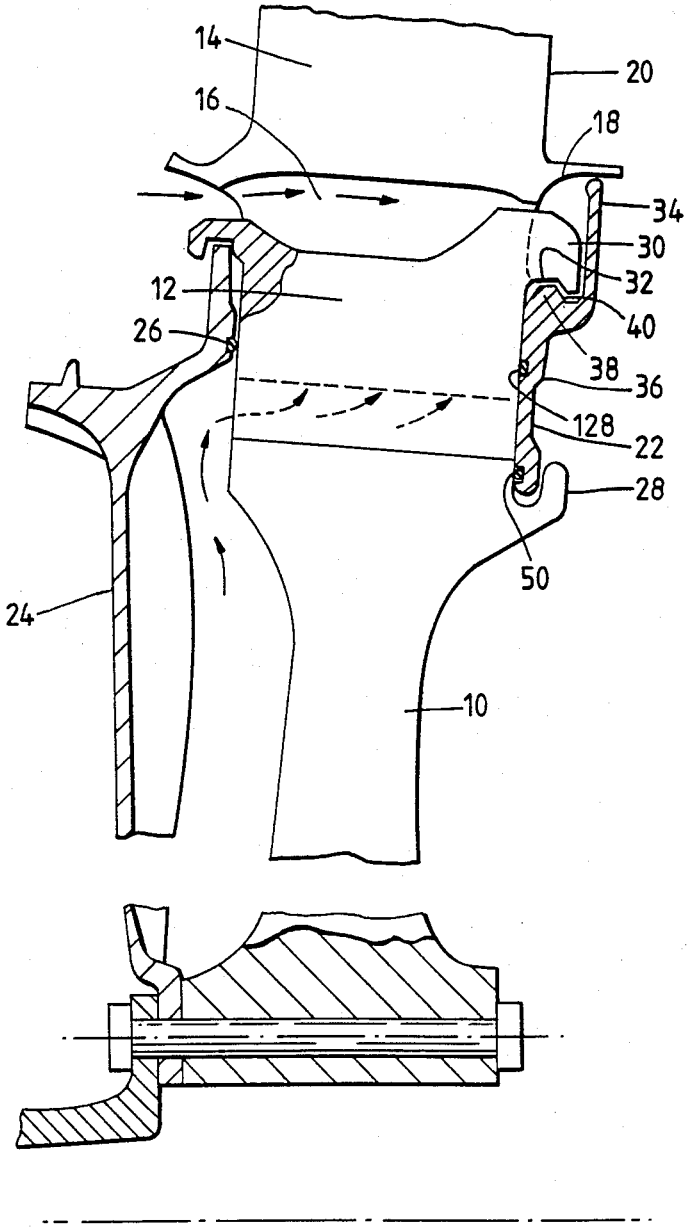
FIG. 1 depicts a sectioned view of a rotor assembly according to the present invention.

Referring to FIG. 1 the rotor assembly comprises a rotor disc 10 having a rim 12, a plurality of blades 14 each comprising a root 16 a platform 18 and an aerofoil 20, and an annular seal plate 22. The rotor disc 10 has blade retaining means in the form of fir-tree slots machined in the rim 12. The blade roots are of a corresponding fir-tree shape and locate within the fir-tree slots in the rim 12 in a manner well known in the art.

The seal plate 22 is required to restrict substantially the flow of cooling air rearward from the downstream side of the disc 10. A very small controlled rearward flow is preferred to ensure adequate cooling. A radially inner flow of cooling air is introduced at the front of the rotor assembly so that it may flow outwards into the blade root slots and through cooling holes (not shown) in the blades. A front cover plate 24 and the rotor disc itself define the flow path of this cooling air, and the periphery of the front cover plate 24 is castellated to provide lands which fit into front hooks on the blades to hold the blades in place axially.

A further flow of cooling air is introduced at a radially outer location so that the blade platforms 18 may also be cooled. A wire seal 26 prevents the two cooling flows from mixing as they are at significantly different pressures at this stage. A further seal, 128 at the same radius, but located in the seal plate 22, fulfills the same purpose.

As mentioned above, it is undesirable for the seal plate 22 to exert a load on the blade platforms 18 due to centrifugal force. But it is also a requirement that the seal plate extends up to the blade platforms in order to adequately seal the rotor assembly. However it is not necessary for the seal plate 22 to contact the platforms providing the gap between the platforms and the periphery of the seal plate is kept as small as possible. The rotor disc is provided with hook means comprising a plurality of restraining members 30 which each include a radially inward directed abutment face 32.

The restraining members 30 are hooked as shown in order to provide axial constraint on the seal plate. Further hooks 28 at the radially inner edge of the rim 12 also provide axial constraint. The seal plate 22 is positioned to one side of the rotor disc rim (the back or downstream side) adjacent the blade root and a radial outer portion 34 of the seal plate extends radially outwards towards the blade platforms 18 to leave a very small radial gap therebetween.

A radially inner portion 36 of the seal plate is located adjacent to the rim 12 and the blade roots 16 to seal therewith. The outer and inner portions 34,36 are axially offset from each other and abutment means 38 are formed on the seal plate 22 at an axially extending joint between the two portions. The abutment means comprise a plurality of flanges 40 (FIG. 3) which each have a radially outward directed abutment face 42 for engagement with the hook means provided on the rotor disc 10. Axial location of the seal plate is thereby achieved by virtue of each hooked restraining member 30 engaging a respective flange 40, and no reliance is placed on the need for the outer periphery of the seal plate to exert axial forces.

When the rotor assembly is rotated, the seal plate 22, which would otherwise move outward under centrifugal force and press against the blade platforms 18, is restrained therefrom by virtue of the restraining members 30 which provide a stop in the form of the abutment faces 32 engaging the abutment faces 42 on the seal plate. the blades 14 are thereby saved from the extra loading that the seal plate 22 would otherwise cause and can therefore be made thinner and lighter. A very small tolerance can be maintained between the portion 34 of the seal plate and the blade platforms 18 to ensure there is no loading whatsoever. A further advantage of the invention is that where shroudless blades are used, operation of any damping mechanism situated between the blades is not affected by the seal plate exerting an extra load on the blades. for optimum sealing the seal plate is preferably continuous although a segmented plate could be used.

Figure 2:
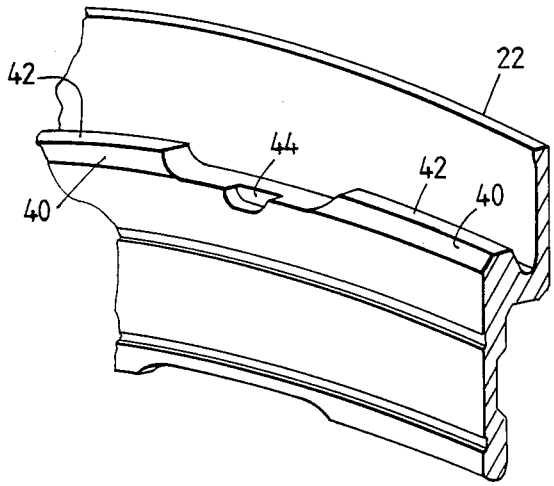
FIG. 2 depicts part of the seal plate shown in FIG. 1.

Referring also to FIG. 2 the seal plate 22 is provided with a plurality of recesses 44 into each extend part 39 of a corresponding blade root 16. By locating blade roots in respective recesses the seal plate is thereby prevented from moving circumferentially with respect to the rotor disc.

Each restraining member spans between adjacent fir-tree slots in the rim 12. During assembly the seal plate is offered up to the rotor disc with each flange 40 aligned with a slot. The seal plate is pushed axially and then twisted with respect to the disc the equivalent of half a pitch (i.e. one half of the distance between each fir-tree slot) so that the each restraining members 30 locates each flange. The blades can then be loaded into the disc from the front of the assembly.

Figure 3:
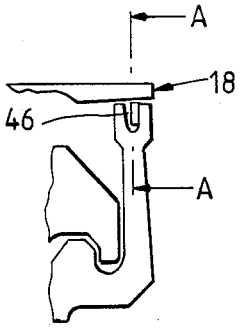
FIG. 3 illustrates a further embodiment of part of the plate seal shown in FIG. 1 wherein the seal plate is provided with sealing members.
Figure 3A:
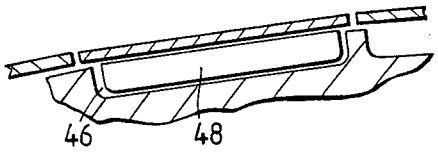
FIG. 3A is a view of the embodiment of FIG. 3 viewed in the direction of arrows A of FIG. 3.

Referring to FIG. 3 the radially outward extending portion 34, in a preferred form comprises a plurality of trenches 46 at its periphery which are each positioned radially inward of a respective blade platform 18. A low density sealing member 48 (for example a ceramic) is located in each trench 46 and is movable outward under centrifugal force to engage the respective platform 18 for sealing therewith and is urged by the pressure of the cooling air rearwards to seal against the seal plate.. In this way a more reliable seal is maintained between the blade platforms 18 and the seal plate 22 and the radial and axial loads on the blade platforms are reduced because the seal plate 22 does not itself load the blade platform.

A compliant wire 50 is located between the radially inner edge on the seal plate 22 and the rotor disc 10 to form a seal therebetween.

Figure 4:
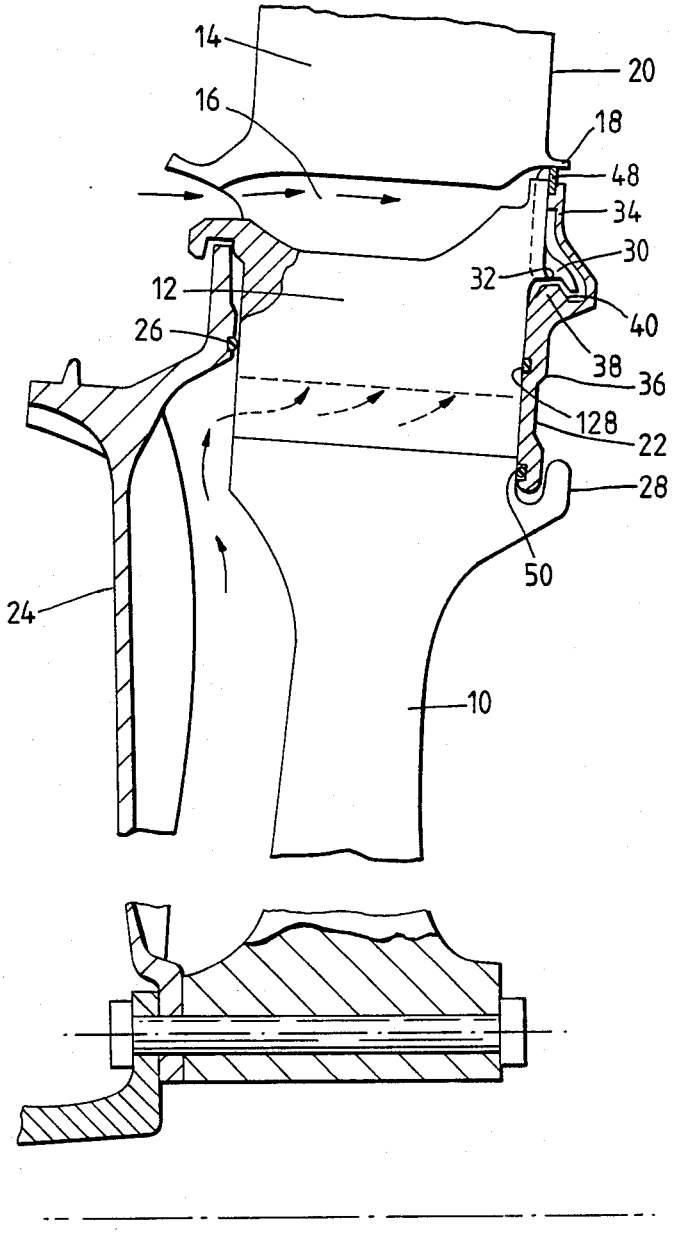
FIG. 4 depicts a sectioned view of a second embodiment of the present invention.

Referring to FIG. 4 there is shown a second embodiment of the invention which is very similar to that of FIG. 3 in that it employs low density sealing members 48. The outer periphery of the seal plate is made lighter by effectively removing one of the flanges that defines the trench 46. The seal plate co-operates with a flange on the outer periphery of the disc to form the trench 46 in which the seal member 48 is located. The outer portion 34 of the seal plate is also inclined towards the disc so as to move the center of mass of at least this portion 34, closer to the disc and inboard of the line of reaction through the radial abutment faces 32,42. This also has the significant advantage of being able to reduce the amount of overhang of the blade platforms 18 at the rear of the blades.

We claim:

1. A rotor assembly for a gas turbine engine, the assembly comprising:

(a) a rotor disc having a rim;

(b) a first hook means located in the rim, said first hook means having a first reaction surface directed radially inwards of the rim and an axially directed second reaction surface;

(c) a second hook means located on the disc radially inwards of the first hook means and facing the disc;

(d) rotor blade retaining means formed in the rim;

(e) a plurality of rotor blades each comprising a root, a platform, and an aerofoil, said blades being attached to the disc by location of the roots in the blade retaining means; and (f) an annular seal plate for sealing engagement with the blade roots and the disc, said seal plate having:

i. a radially outer portion terminating in a radially outer periphery extending to, but not contacting, the blade platform;

ii. a radially inner portion axially offset from the outer portion and adapted to engage the second hook means and to contact the disc; and iii. an intermediate portion located between the outer and inner portions, said intermediate portion having an abutment means provided by the axial offset between the inner and outer portions, said abutment means comprising a radially outward facing abutment surface adapted to engage the first reaction surface of the first hook means and an axially facing surface adapted to engage the second reaction surface of the first hook means, thereby to urge the seal plate into sealing engagement with the disc and the blade roots without imposing significant axial or radial loading on the blade platforms.

2. A rotor assembly as claimed in claim 1 wherein the abutment means extends radially outwards so as to contact the first reaction surface of the first hook means and thereby prevent the generation of significant axial loads by the outer periphery of the seal plate on the platform due to centrifugal loads on the seal plate, when the rotor rotates.

3. A rotor assembly as claimed in claim 1 wherein said second hook means is provided with a reaction surface facing the disc and contacting an axial surface of the radially inner portion of the seal plate.

4. A rotor assembly as claimed in claim 1 wherein there are provided a plurality of circumferentially extending trenches in the outer periphery of the seal plate and a plurality of movable sealing members each located in a respective trench, each sealing member and respective trench being located radially inward of a blade platform in order for the sealing member to engage said blade platform for sealing therewith when said sealing member is subjected to centrifugal force.

5. A rotor assembly as claimed in claim 1 wherein the abutment means comprises a plurality of circumferentially spaced flanges each having a radially outward directed abutment face for engagement with the first reaction surface of the first hook means.

6. A rotor assembly as claimed in claim 5 wherein the first hook means comprises a plurality of spaced hooks which engage and constrain the flanges, and hence the seal plate, axially.

7. A rotor assembly according to claim 1 wherein the seal plate is further provided one or more recesses for engagement with the blade roots in order to prevent relative movement between the rotor disc and seal plate.

8. A rotor assembly according to claim 4 wherein each sealing member is formed from a ceramic material.

* * * * *